US005757135A

United States Patent [19]

Wiedijk

[11] Patent Number: 5,757,135

[45] Date of Patent: May 26, 1998

[54] HIGH-PRESSURE DISCHARGE LAMP

[75] Inventor: Piet Wiedijk, Turnhout, Belgium

[73] Assignee: U.S. Philips Corporation, New York, N.Y.

[21] Appl. No.: 623,386

[22] Filed: Mar. 27, 1996

[30] Foreign Application Priority Data

Mar. 28, 1995 [EP] European Pat. Off. ..... 95200780
Dec. 6, 1995 [EP] European Pat. Off. ..... 95203365

[51] Int. Cl.[6] ..... H01J 61/00
[52] U.S. Cl. ..... 313/623; 313/624
[58] Field of Search ..... 313/623, 624

[56] References Cited

U.S. PATENT DOCUMENTS

| | | | |
|---|---|---|---|
| Re. 30,165 | 12/1979 | Mason et al. | 313/624 |
| 3,742,117 | 6/1973 | Levand, Jr. et al. | 313/623 |
| 3,984,590 | 10/1976 | Mason et al. | 427/106 |
| 4,027,073 | 5/1977 | Clark | 428/412 |
| 4,106,840 | 8/1978 | Tyson | 313/477 R X |
| 4,691,142 | 9/1987 | Dohmen | 313/623 |
| 5,064,395 | 11/1991 | Kling et al. | 313/623 |
| 5,155,612 | 10/1992 | Adachi et al. | 349/111 |
| 5,387,840 | 2/1995 | Noteleteirs et al. | 313/623 |
| 5,498,927 | 3/1996 | Vervecken et al. | 313/624 X |

FOREIGN PATENT DOCUMENTS

0364014A1 4/1990 European Pat. Off. .

*Primary Examiner*—Hezron E. Williams
*Assistant Examiner*—Daniel S. Larkin
*Attorney, Agent, or Firm*—Walter M. Egbert

[57] ABSTRACT

The invention relates to an electric lamp provided with a body which radiates light in the operational state of the lamp and which is enclosed with intervening space by an outer lamp envelope which is provided at one end with a stemtube with a pinch and which supports a lamp cap shell, through which pinch current lead-through conductors extend, each current lead through conductor being connected to a contact point of the lamp cap shell via an external conductor. According to the invention, each of the current lead-through conductors and the accompanying external conductors is provided with a moisture-repelling coating at least at the area of a mutual welded joint.

22 Claims, 1 Drawing Sheet

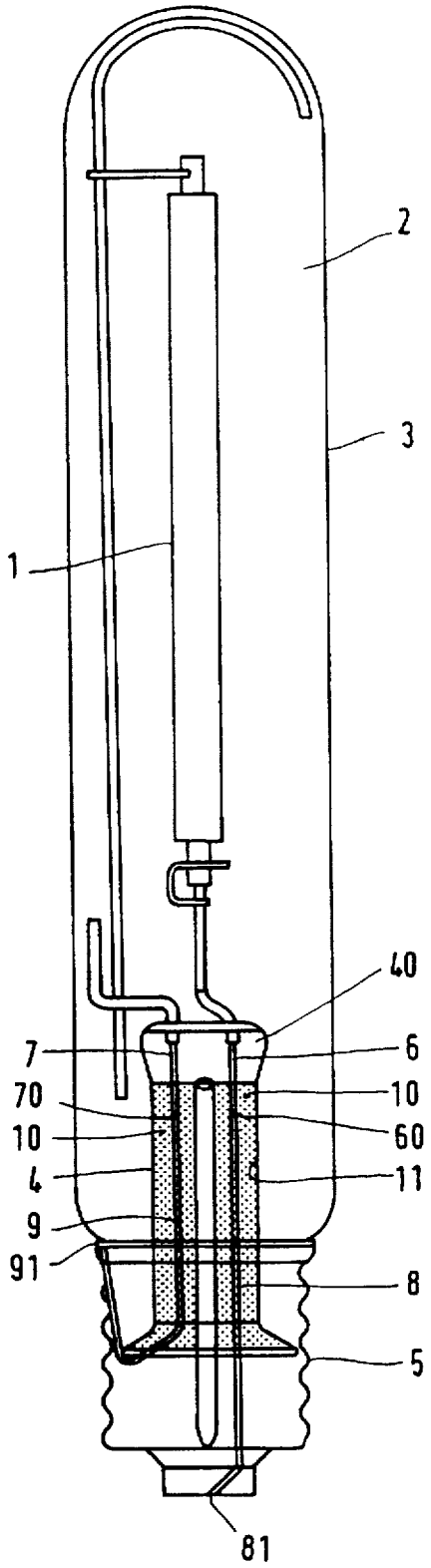
2
3
1
40
7
6
70
10
10
60
4
11
9
91
8
5
81

HIGH-PRESSURE DISCHARGE LAMP

BACKGROUND OF THE INVENTION

The invention relates to an electric lamp provided with a body which radiates light in the operational state of the lamp and which is enclosed with intervening space by an outer envelope which at one end is provided with a stemtube having a pinch and which supports a lamp cap shell, through which pinch current lead-through conductors extend, each current lead-through conductor being connected to a contact point of the lamp cap shell by means of an external conductor.

A lamp of the kind mentioned in the opening paragraph is known from EP-A-0 364 014. The known lamp is particularly suitable for use in crop irradiation installations for promoting photosynthesis. This application implies that the lamp is exposed to a humid environment which in addition will often be mixed with corrosive substances which promote plant growth. Especially the presence of a liquid (liquid water) causes destructive corrosion which manifests itself in particular at the area of a connection between different metals. Current interruptions frequently arise in the known lamp, sometimes as early as after 4,000 hours of operation, in the conductors between the pinch and the lamp cap shell, which means a premature end of lamp life.

It has been suggested to coat the current lead-through conductors with a mixture of a readily oxidizable metal, a binder, and a filler to counteract attacks on the current lead-through conductors and the pinch. It is indeed achieved thereby that oxidation of the readily oxidizable metal of the coating only takes place initially, but this leads to only a temporary improvement, in practice of the order of 1,000 hours. A further disadvantage is that such a coating will show cracks after some time owing to differences in coefficient of expansion between the conductors and the coating material.

The invention has for its object to provide a means for counteracting current interruptions in the conductors between the pinch and the lamp cap shell which is of a durable character and can be applied on an industrial scale in a comparatively simple manner.

According to the invention, a lamp of the kind mentioned in the opening paragraph is for this purpose characterized in that each current lead-through conductor has a welded joint with the relevant external conductor, and the current lead-through conductors and the external conductors are provided with a moisture-repelling coating at least at the area of each welded joint.

SUMMARY OF THE INVENTION

The lamp according to the invention has the advantage that the moisture-repelling, i.e. protective layer itself is not attacked by the corrosive environment. This means that lamp life is not influenced by a limitation of the lives of the current lead-through conductors and the external conductors. The current lead-through conductors and the external conductors are preferably provided with the moisture-repelling coating from the pinch to close to the lamp cap shell here. On the one hand this can be realized in a comparatively simple manner during manufacture, and on the other hand it leads to a more durable protection against corrosion.

In the lamp according to the invention, the stemtube with the pinch has a wall surface facing the welded joint which is preferably also coated with the moisture-repelling layer. This renders it possible to inspect the quality of the coating visually. This is enhanced yet further when the moisture-repelling layer is provided with a coloring agent.

The moisture-repelling coating is preferably provided after all high-temperature glass processes forming part of lamp manufacture have been completed. This has the advantage that the temperature resistance of the coating need apply only to temperatures prevailing between pinch and lamp cap shell during lamp operation. In practice, these are temperatures between 250° C. and 350° C.

The material of the coating, therefore, must be resistant to heating for a long period (for example, 10,000 hours) at a temperature in the above range. Materials based on an organic polymer are particularly suitable for this. Suitable organic polymers are those based on silicon compounds (for example, silicone resin, silicone rubber, polysiloxane), based on nitrogen compounds (polyimides), and based on fluorine compounds (teflon).

Apart from a desired temperature resistance, all the above materials have a strong water-repelling character. When choosing the form in which the coating is present, one should take into account differences in coefficient of expansion of the relevant material on the one hand and of the current lead-through member, the external conductors, and the stemtube on the other hand. Preferably, the moisture-repelling coating is present in the form of an elastic foam. This is particularly suitable in the case of silicone rubber, which has the additional advantage that no noxious substances are evolved during foaming. Teflon may also be readily applied in the form of a foam.

Another suitable method is to provide the moisture-repelling coating in the form of a very thin layer. Thus experiments have shown that silicone resin as a moisture-repelling coating should preferably be present as a layer with a thickness of at most 1 μm. Layer thicknesses above 1 μm often lead to cracks in the coating during lamp life, so that the moisture-repelling function is lost.

A further method of realizing the moisture-repelling coating is to provide a glass fiber sleeve impregnated with a moisture-repelling material at least at the area of the welded joint.

A further suitable group of materials known from U.S. Pat. No. 4,027,073 and having good moisture-repelling properties, while in addition being resistant to temperatures prevailing in a lamp cap, is polysiloxane. In particular, phenylmethyl polysiloxane has proved to be highly suitable.

The moisture-repelling layer may be provided in various ways. Preferably, the moisture-repelling layer is provided in that a suitable solution is made to flow over the conductors and wall portions to be coated. Immersion of the hermetically closed outer envelope in a suitable solution is another possibility.

The invention is applicable to a high-pressure discharge lamp in which the light-radiating body is formed by a discharge vessel. The filling of the discharge vessel of the lamp generally comprises an ionizable metal, such as Hg, and a rare gas, for example Ar, Ne, Xe, or a combination of rare gases. In addition, the filling may comprise yet further ingredients, for example, Na and/or metal halides. The invention is equally applicable to low-pressure discharge lamps, in particular compact fluorescent lamps. The discharge vessel in such a lamp is again the light-radiating body. It is also possible for the lamp to be an incandescent lamp, where the light-radiating body is formed by an incandescent coil.

BRIEF DESCRIPTION OF THE DRAWINGS

The above and further aspects of the invention will be explained in more detail with reference to a drawing.

The FIGURE illustrates an electric lamp constructed in accordance with a preferred embodiment of the subject invention.

DESCRIPTION OF THE PREFERRED EMBODIMENTS

The drawing shows an electric lamp provided with a body 1 which radiates light in the operational state of the lamp and which is enclosed with intervening space 2 by an outer envelope 3 which is provided at one end with a stemtube 4 having a pinch 40 and which supports a lamp cap shell 5, through which pinch 40 current lead-through conductors 6, 7 extend, each current lead-through conductor having a welded joint 60, 70 with an external conductor 8, 9 which is connected to a respective contact point 81, 91 of the lamp cap shell, said welded joint lying between the pinch and the lamp cap shell. In the embodiment shown, the moisture-repelling coating is present in the form of an elastic foam 10, so that the current lead-through conductors and the external conductors are provided with the moisture-repelling coating at the area of each welded joint.

In an alternative embodiment, the current lead-through conductors and the external conductors are provided with the moisture-repelling coating in the form of a very thin layer from the pinch to adjacent the lamp cap shell. In a further embodiment, also the wall surface 11 of the stemtube and pinch facing the weld is substantially provided with a very thin layer of the moisture-repelling coating.

The use of a coating containing a coloring agent renders it possible to ascertain whether the coating is continuous in a simple visual inspection.

In a practical realization of a lamp according to the embodiment described, the coating is formed by an elastic foam of silicone rubber. The coating is realized by the local application of a small quantity of a well mixed two-component material in the stemtube of the lamp. A few percents of an organic coloring agent are added to the two-component material for coloring the coating.

A dispensing system for applying the mixture of the two-component material preferably comprises a dispenser nozzle which is arranged in an opening of the lamp cap shell during the application of the material. After being applied, the material expands so as to form an elastic foam which entirely fills the stemtube. Foam formation takes place within one minute at room temperature.

What is claimed is:

1. An electric lamp comprising:

a body which radiates light in the operational state of the lamp;

an outer envelope enclosing the body with intervening space therebetween;

a stemtube provided at one end of the envelope and having a pinch;

a lamp cap shell supported by the outer envelope and having a contact point;

current lead-through conductors extending through the pinch;

external conductors, each external conductor having a first end connected to a respective current lead-through conductor and a second end connected to a contact point of the lamp cap shell;

characterized in that: each current lead-through conductor has a welded joint with the respective external conductor between the pinch and the lamp cap shell, and the current lead-through conductors and the external conductors are provided with a moisture-repelling coating at least at the area of each welded joint.

2. A lamp as claimed in claim 1, characterized in that the current lead-through conductors and the external conductors are provided with a moisture-repelling coating from the pinch to adjacent the lamp cap shell.

3. A lamp as claimed in claim 2, characterized in that the stemtube with the pinch has a wall surface facing the welded joint, and said wall surface is substantially provided with the moisture-repelling coating.

4. A lamp as claimed in claim 3, characterized in that the moisture-repelling coating is provided with a coloring agent.

5. A lamp as claimed in claim 4, characterized in that the moisture-repelling coating comprises an organic polymer.

6. A lamp as claimed in claim 5, characterized in that the moisture-repelling coating is present in the form of an elastic foam.

7. A lamp as claimed in claim 3, characterized in that the moisture-repelling coating comprises an organic polymer.

8. A lamp as claimed in claim 7, characterized in that the moisture-repelling coating is present in the form of an elastic foam.

9. A lamp as claimed in claim 2, characterized in that the moisture-repelling coating comprises an organic polymer.

10. A lamp as claimed in claim 9, characterized in that the moisture-repelling coating is present in the form of an elastic foam.

11. A lamp as claimed in claim 1, characterized in that the moisture-repelling coating comprises an organic polymer.

12. A lamp as claimed in claim 11, characterized in that the moisture-repelling coating is present in the form of an elastic foam.

13. A lamp as claimed in claim 2, characterized in that the moisture-repelling coating is provided with a coloring agent.

14. A lamp as claimed in claim 13, characterized in that the moisture-repelling coating comprises an organic polymer.

15. A lamp as claimed in claim 14, characterized in that the moisture-repelling coating is present in the form of an elastic foam.

16. A lamp as claimed in claim 1, characterized in that the moisture-repelling coating is provided with a coloring agent.

17. A lamp as claimed in claim 16, characterized in that the moisture-repelling coating comprises an organic polymer.

18. A lamp as claimed in claim 17, characterized in that the moisture-repelling coating is present in the form of an elastic foam.

19. A lamp as claimed in claim 1, characterized in that the stemtube with the pinch has a wall surface facing the welded joint, and said wall surface is substantially provided with the moisture-repelling coating.

20. A lamp as claimed in claim 19, characterized in that the moisture-repelling coating is provided with a coloring agent.

21. A lamp as claimed in claim 20, characterized in that the moisture-repelling coating comprises an organic polymer.

22. A lamp as claimed in claim 21, characterized in that the moisture-repelling coating is present in the form of an elastic foam.

* * * * *